United States Patent [19]

Wilson

[11] Patent Number: 4,541,532

[45] Date of Patent: Sep. 17, 1985

[54] SIDE KICK SOLIDS SEPARATOR

[76] Inventor: William A. Wilson, 83 Pheasant Dr., Marietta, Ga. 30067

[21] Appl. No.: 497,897

[22] Filed: May 25, 1983

[51] Int. Cl.[4] ..... B07B 13/05

[52] U.S. Cl. ..... 209/651; 198/598; 209/658; 209/663

[58] Field of Search ..... 209/606, 615, 616, 624, 209/651, 654, 656, 658, 660, 663, 667, 671, 695, 627; 198/364, 598, 599

[56] References Cited

U.S. PATENT DOCUMENTS

| | | | |
|---|---|---|---|
| 3,583,564 | 6/1971 | Seesen | 209/616 |
| 4,155,442 | 5/1979 | Gosling et al. | 198/598 |

FOREIGN PATENT DOCUMENTS

| | | | |
|---|---|---|---|
| 80050 | 6/1919 | Fed. Rep. of Germany | 198/598 |
| 1028638 | 5/1953 | France | 209/663 |

*Primary Examiner*—David A. Scherbel
*Assistant Examiner*—Donald T. Hajec
*Attorney, Agent, or Firm*—Harry I. Leon; Vivian L. Leon

[57] ABSTRACT

A machine for removing oversize solids such as large rocks from other material carried by a conveyor. This separator has a wheel with external spokes which radiate outward from its circumference and which is mounted above the conveyor at an angle to the centerline thereof. Requiring no external power source, the device is actuated by the solids to be separated with the energy for separation being derived from their motion on the conveyor. When solids larger than the desired size come into contact with the spokes of the wheel, part of the momentum of these objects is converted to rotational motion of the wheel. As it rotates, it has a tendency to deflect them laterally across the conveyor belt until they are pushed off the side of the conveyor.

The wheels can be used singularly or in combination. Their use in combination is most desirable for wider belts. The wheels can be located at varying locations, angles, and heights above the belt. By experimental methods, the wheels are adjusted for optimum placement. The sizing of the wheels is predicated on the size of the solids being removed, the depth of the material on the belt, the width of the conveyor and its speed.

13 Claims, 3 Drawing Figures

SIDE KICK SOLIDS SEPARATOR

BACKGROUND OF THE INVENTION

1. Field of the Invention

This invention relates generally to the separation of solids and particularly to the removal of larger solids from a mixture in which they are present with smaller solids travelling on a conveyor. Although this invention can handle a wide range of solids separations, it has been found especially useful in the separation of oversize material in rock crushing, gravel pit, mining and similar operations.

2. Description of the Prior Art

Prior to this invention, gratings or screens having openings only large enough to allow the passage of material below a certain set size were utilized to remove oversize solids from a mixture. Unfortunately, such gratings and screens frequently become plugged or damaged by the oversized solids making them impractical in many cases. However, if large rocks or the like are allowed to pass unchecked, they can cause problems in the processing equipment. The alternative method has been to remove the larger solids manually from the moving conveyor. Because of the risk and labor involved, this approach is practicable only when there is an occasional rock or other solid requiring removal.

SUMMARY OF THE INVENTION

The object of the invention is to provide an improved method and apparatus which can be utilized without operator assistance to dislodge oversize solids from an aggregate type material in which they are present in large numbers as well as an occasional oversize object on a moving conveyor. According to the invention, a rake having at least one rotatable disk wheel from the circumference of which bar type spokes radiate at spaced intervals is positioned so that objects larger than a predetermined size riding on the conveyor strike at least one of the spokes and impart rotational motion to the wheel while at the same time the smaller objects tend to move out from under the spokes and be transported by the conveyor until they discharge off its end.

The wheel is supported so that the angle of incidence of an object being moved by the conveyor in its longitudinal direction upon a face of one of the spokes is an acute one preferably in the range of 35 to 60 degrees. Thus when a large rock or similar sized solid travelling on the conveyor collides with at least one of the spokes, some of the forward momentum of the rock is converted into rotational motion of the wheel. If there is sufficient clearance between the bulk of the aggregate and the spokes, the spokes will then flip the rock as it encounters them a second time and kick it sideways across the conveyor in the direction of the tangent of the rotation of the wheel. As the angle of incidence increases and the wheel correspondingly becomes more nearly parallel to the centerline of the conveyor, a greater portion of the momentum of the rock is transformed into rotational motion causing the wheel to rotate faster. Depending upon the conveyor width and speed, the clearance between the aggregate being transported on it and the spokes, the size and spacing of the spokes, and the angle of incidence, the action of one wheel may be of sufficient force to push the rock off the conveyor.

To improve the efficiency with which oversize objects are dislodged from conveyors, rakes having more than one disk wheel are provided. In rakes having two disk wheels wheel, each wheel is supported so that its center is located above the conveyor on opposite sides of the centerline thereof and spaced longitudinally from the other. Such rakes are especially useful in operations in which oversize rocks are present in large numbers in aggregate from which they must be separated since in such a situation, a single large rock may stop the action of a rake having only one wheel. With a rake having two wheels, such an occurence is avoided by positioning the center of the upstream wheel so that the tips of its spokes just touch the top of the larger rocks. Thus disposed, the upstream wheel can flip rocks weighing up to 600 lbs. and force them sideways off the belt. Once the upstream wheel has dislodged the largest oversize objects, the downstream wheel which is set closer to the conveyor can be utilized to force off the smaller ones.

A further provision to improve the efficiency with which oversize objects are dislodged includes means for supporting a rake having two wheels in which the angle of incidence of an object being moved by the conveyor in its longitudinal direction upon a face of one of the spokes of the upstream wheel is less than the angle of incidence of the downstream wheel. Since the spacing between the spokes projected on a plane perpendicular to the belt is greater for the upstream wheel than for the downstream one, smaller oversize objects can be dislodged by the downstream wheel.

To accomodate wide conveyors, rakes having three or more rotatable wheels are provided. In a preferred embodiment having three such wheels, the wheels are disposed in successive transferring relationship with each wheel being supported so that its center is spaced longitudinally from the other. The wheel which is located furthest downstream is situated proximate the edge of the conveyor which oversize objects traverse as they are being dislodged by the rake from the conveyor. An oversize object initially contacting one or more spokes of an upstream is directed along a path which angles away from the longitudinal axis of the conveyor until the object is forced off the edge thereof.

The invention further comprehends a series of rakes in which each one positioned downstream of another is utilized to separate smaller oversize objects from an aggregate type material moving on a conveyor than the rake immediately upstream of it.

Further features of the invention include the design and arrangement of the rotatable disk wheel and of the spokes attached thereto.

BRIEF DESCRIPTION OF THE DRAWINGS

Further details are explained below with the help of the examples illustrated in the attached drawings in which.

DESCRIPTION OF THE PREFERRED EMBODIMENT

Figure 1:
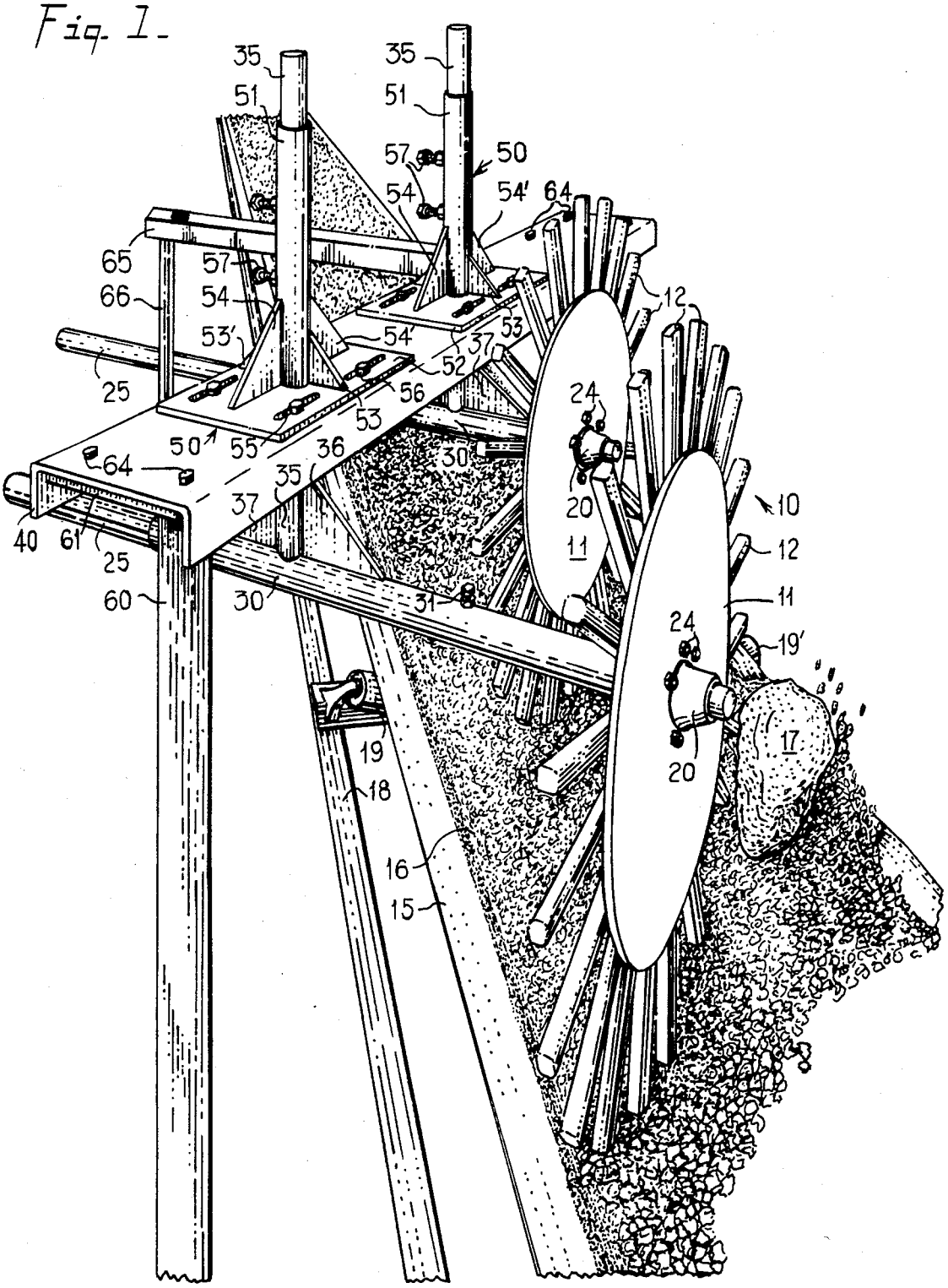
FIG. 1 is a perspective view of one embodiment having a pair of wheels mounted in position to remove oversize rocks from aggregate as it is being moved on a conveyor belt.

Referring to FIG. 1 of the drawing, a rake 10 incorporating the invention is shown suspended above the bulk of an aggregate type material 16 as a rotatable disk wheel 11 in the rake 10 and some of its spokes 12 force an oversize rock 17 generally sideways and off the conveyor. The energy for dislodging such a rock is imparted by it to the wheel 11 when the rock, travelling with the conveyor at a speed which in most applications is between 350 and 1200 feet per minute, collides with one or more of the spokes 12. As described hereinbelow, each spoke 12 is disposed so that a substantial portion of the momentum of the rock, upon such as impact, is transformed into rotational motion of the wheel 11 about its axis of symmetry.

Figure 2:
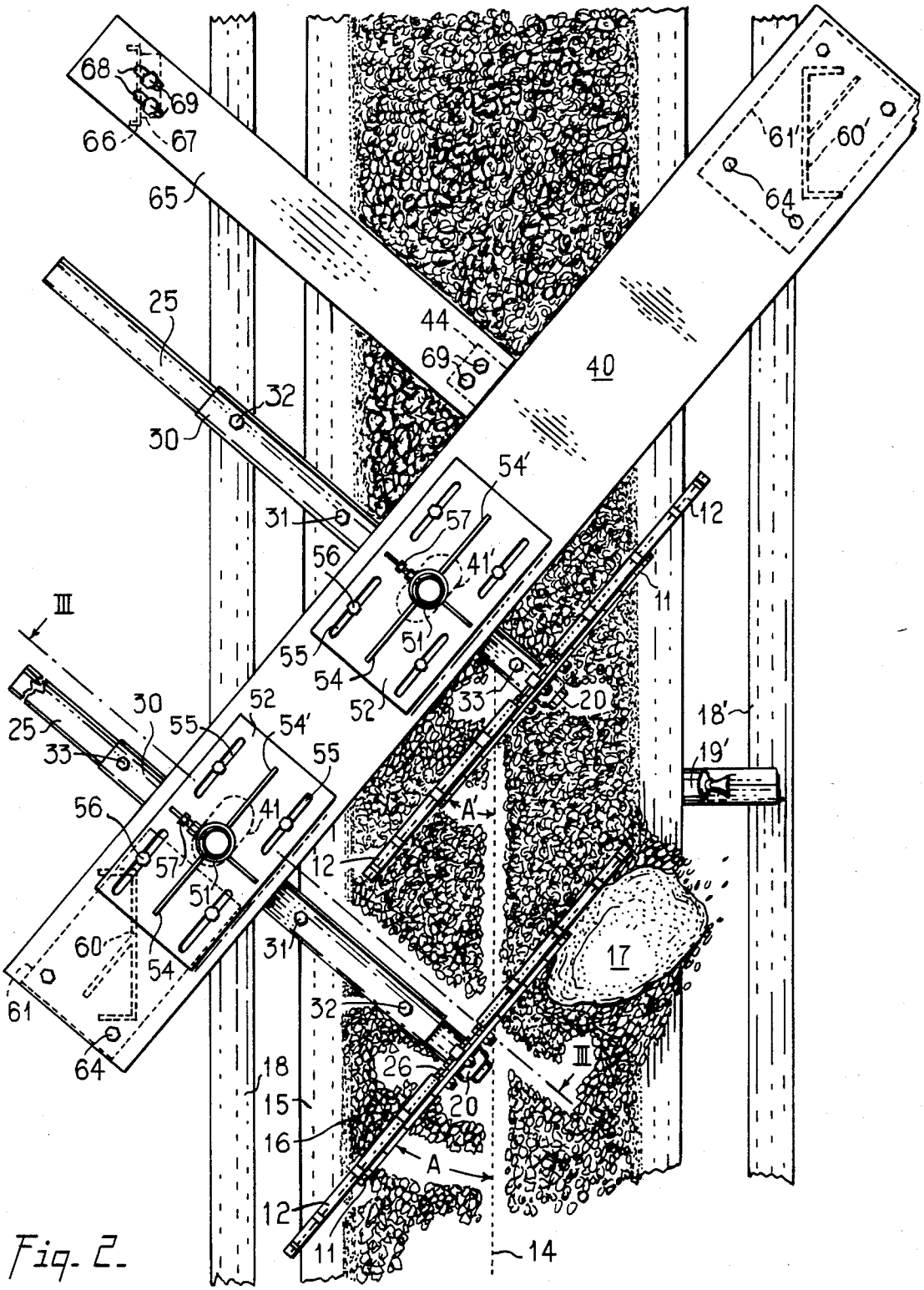
FIG. 2 is a plan view of FIG. 1.
Figure 3:
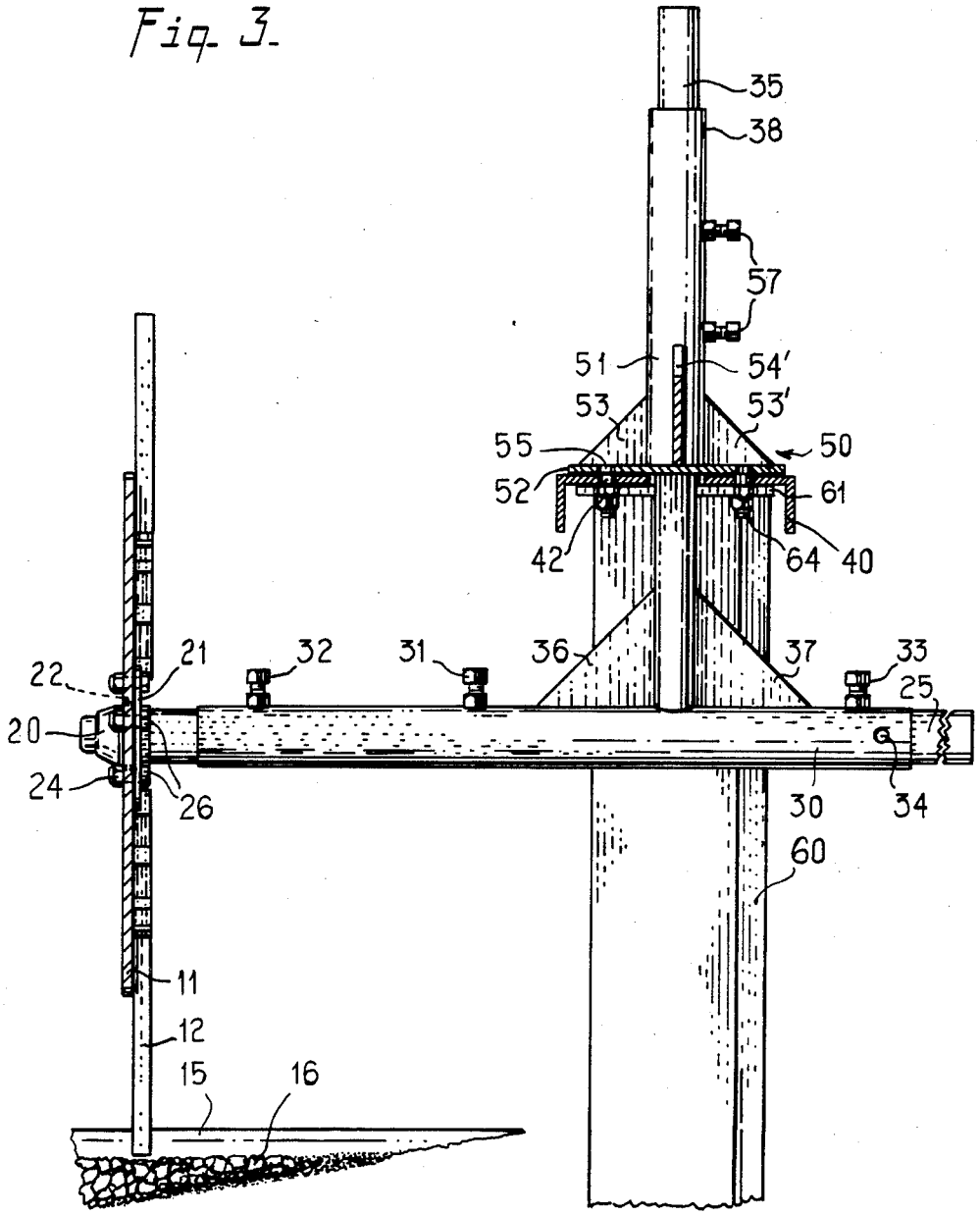
FIG. 3 is an enlarged cross-sectional view taken on line III—III of FIG. 2.

In the preferred embodiment shown in FIGS. 1–3, the rake 10 has two wheels 11 to each of which a plurality of spokes 12 are rigidly attached and from which they extend radially outward at spaced intervals. The wheels 11 are preferably fabricated from steel plate to which the spokes 12 formed from high carbon steel bars or the like are welded. The actual size of each wheel 11 with its spokes 12 and the spacing between the spokes varies with the average weight and cross dimensions of the oversize objects to be separated and with the speed and frequency with which they encounter the spokes. In general, the heavier the objects to be separated the larger the size of the wheel 11 with its spokes 12 which is required to deflect the objects from a course parallel to the longitudinal axis of the conveyor. A further consideration is the curvature of the circular path traced by the outer extremity of each spoke 12, with a span of approximately 36 inches between the outer extremities of two diametrically opposed spokes 12 in the wheel 11 approaching the minimum. By way of example, applications in which large rocks, including boulders weighing approximately 600 lbs., must be separated from material being moved on a conveyor belt, the distance between the outer extremities of any two diametrically opposed spokes 12 on a wheel 11 is approximately 42 inches; and preferably there are twenty spokes 12 attached to each wheel 11 with the distance separating the centers of the outermost portions of a contiguous pair of spokes 12 being approximately 6.5 inches.

Each wheel 11 is rotatably supported by a bearing and hub assembly 20 which is mounted on a horizontal shaft 25. As is best illustrated in FIG. 3, the wheel 11 has a central opening 22 and holes formed concentrically about it for receiving the forward portion of the assembly 20 and the bolts 26, respectively. The bolts 26 and their nuts 24 are employed to hold the flange 21 of the assembly 20 and the wheel 11 in assembled relation.

The horizontal shaft 25 which itself may be a pipe is slidably received by a horizontal support arm 30 which is rigidly attached to a mast 35 and together with it to a pair of corner braces 36, 37. The shaft 25 is secured to the arm 30 by set screws 31, 32, 33 and provides means for positioning the center of the wheel 11 with respect to the centerline 14 of the conveyor 15. Moreover, the portion of the shaft 25 contiguous the hole 34 formed in the arm 30 may be drilled to receive a pin to fix the position of the shaft within the arm (FIG. 3).

The mast 35 which is preferably fabricated from a pipe and partially filled by a round shaft plug welded therein is slidably received by the tube 51 of the slider assembly 50 which is mounted on the main cross member 40. As shown in FIGS. 2 and 3, the member 40 has elongated slots 41, 41' each formed therein for receiving one of the masts 35 and aligned with the central passageway of a tube 51. Each mast 35 slidably received by a tube 51 and secured thereto by a pair of set screws 57 comprises means for positioning the wheel 11 with the outer extremity of each spoke 12 attached to it being movable in a circular path which is spaced a desired distance above the conveyor 15 and with the axis of symmetry of the wheel at an acute angle to the centerline 14 of the conveyor.

The slider assembly 50 comprises a base 52 which is rigidly attached to the tube 51 and together with it to two pairs of gussets 53, 53' and 54, 54'. The base 52 and the main cross member 40 have sets of elongated slots 55 and 42, respectively, formed therein which are aligned with each other to receive bolts 56 to hold the slider assembly 50 and the member 40 in assembled relation (see FIGS. 2 and 3). The slots 55, 42 facilitate the positioning of the wheels 11 by providing means for adjusting the location of the masts 35 within the slots 41, 41'.

As is best illustrated in FIG. 2, the main cross member 40 is supported by a pair of plates 61, 61' welded to support legs 60, 60', respectively, with a corner brace strengthening each joint. Moreover, the member 40 is reinforced by a backstop cross member 65. The plates 61, 61' each have a set of holes formed therein which are aligned with openings formed in the cross member 40 to receive the bolts 64 in order to secure the plates 61, 61' to the member 40. Both the backstop cross member 65 and an angle piece 44 rigidly attached to the member 40 each have a set of holes formed therein for receiving the bolts 69 and securing the members 40, 65 to each other. Similarly, the member 65 and an angle segment 67 welded to the vertical leg 66 each have a pair of slots 68 and of holes, respectively, for receiving the bolts 69 and for securing the member 65 to the leg 66.

The legs 60, 60', 66 are fastened by bolts or the like to rigid support structures (not shown) adapted to each application which preferably are attached to frame elements 18, 18' of the trust supporting the conveyor with the main cross member 40 being disposed at an acute angle to the centerline 14. Preferably, this angle is equal to the complement of the desired angle of incidence of an object being moved by the conveyor in its longitudinal direction upon a face of one of the spokes 12 of the upstream wheel 11 so that the distance between the center of each wheel 11 and the member 40 can be kept to a minimum.

In operation, the rake 10 transforms a portion of the forward momentum of an oversize object carried by a conveyor into rotational motion of the wheel 11 and absorbs the remainder of its translational energy. Due to the weight of the object and its speed, considerable momentum is imparted to the spokes 12 of a wheel 11 upon impact. The component of this momentum which is parallel to the tangent of the wheel 11 is largely transformed into rotational motion which causes the spokes 12 to strike oversize objects which may be contiguous thereto initially as well as those which encounter the spokes as they are moving. Forcing these oversize objects generally sideways, the spokes 12 tend to dislodge them from the conveyor or direct them towards an encounter with the spokes 12 of another wheel 11 situated downstream.

In field trials, it has been found that having the angle of incidence in the range of 35 to 60 degrees provides optimum conditions for dislodging oversize objects with the use of the rake 10. In the preferred embodiment illustrated in FIGS. 1–3, the member 40 and both of the wheels 11 are disposed at an angle A, A' of 40 degrees to the centerline 14. A determination of the optimum angle for each wheel 11 is best made after prototype testing at the site for each application. Similarly, the optimum height at which the center of each of the wheel 11 is mounted above the conveyor and its position relative to the centerline 14 and to other wheels 11 which may be present varies with the situation in which the rake 10 is being utilized.

In an application in which oversize objects must be dislodged from an aggregate type material such as crushed rock in which they are present in large numbers, the rake 10 is supported over a section of the conveyor in which there has been established a differential in height between various components of the material riding thereon on the basis of their size with the tops of the largest objects tending to be uppermost and with the smaller ones having been shifted downward between them. Such a distribution in the aggregate may be approached by minimizing the depth at which the material is carried on a conveyor. It is frequently desirable to reduce this depth prior to installing the rake 10 by setting the idlers 19, 19' supporting the belt so that they create a more shallow trough.

Once such a size distribution has been established, the center of the wheel 11 is then positioned at a distance from the conveyor so that the tips of its spokes 12 are above the average height at which objects tend to ride thereon which have each of their cross dimensions less than a predetermined size. The actual distance at which the center of the wheel 11 is disposed above the conveyor is also dependent upon the size and frequency of the largest oversize objects which must be dislodged, the width of the conveyor, its speed, the depth of the material burdening it, and the number of wheels being utilized. Field trials show that a rake 10 can remove approximately 95% of the rocks measuring approximately 8 inches by 15 inches and no more than 4 inches thick (substantially one-half the size of a conventional wastebasket) and larger from a moving conveyor fed by a primary crusher. This oversize rock is itself a marketable product known as rip-rap. Alternately, a series of rakes 10 can be employed along the length of the conveyor to segregate the rip-rap stone into various types including surge stone and gabion stone.

In the preferred embodiment illustrated in FIGS. 1–3, the center of the upstream wheel 11 has been positioned so that the outer extremities of the spokes 12 pass along a circular path just below the upper side edges of the conveyor 15 and above the bulk of the material 16 burdening it. In such a configuration, the rake 10 may be employed to dislodge boulders or the like weighing up to 600 lbs. from an aggregate type material such as sand and gravel. With clearance between the spokes 12 and the aggregate, the spokes, once the wheel 11 is set in rotation, will flip such boulders sideways and off the conveyor where they may be collected and sold for landscaping.

A further application of the rake 10 includes the removal of smaller rocks, large chunks of clay and mudballs ranging in weight from ½ to 150 lbs., fossil remains, and miscellaneous trash from an aggregate such as sand and gravel, coal or the like in which frequently at least one cross dimension of an oversize object is sufficiently small that it may be hidden within the aggregate as it is being moved by the conveyor. To achieve about 75 to 85% efficiency in the removal of such submerged oversize objects, a rake 10 having at least two wheels 11 is employed. The centers of the wheels are positioned so that tips of their lowermost spokes 12 penetrate a portion of the depth of the aggregate and can lift objects therefrom. The downstream wheel is required to push the oversize objects off the conveyor while the upstream one lifts them from the aggregate. To improve the efficiency, a third wheel may be utilized as described hereinbelow.

To facilitate the removal of submerged oversize objects which might hide near the lowest portion of the trough formed by the conveyor belt under such conditions, it is frequently desirable to reduce the depth of the material carried on it prior to the installation of the rake 10. A further consideration is the desirability of having the aggregate fed onto the conveyor at a consistent rate. Otherwise, blinding of the wheel 11 may occur when the depth of material its spokes must penetrate is too great since the flow of aggregate around them becomes more impeded the closer it comes to the juncture of the spokes 12 with the wheel 11.

A further application in which a rake 10 having at least two wheels 11 is preferably utilized is one in which there is a relatively small differential in the sizes of the cross dimensions of the components of the aggregate which are to be segregated and of those of a substantial number of components which are to be allowed to bypass the rake. To separate objects larger than the spacing between the spokes from each other, such a rake is employed with the center of the upstream wheel 11 being disposed so that the tips of its spokes 12 penetrate less of the aggregate than does the downstream wheel. This arrangement is more effective when each of the wheels 11 is positioned to penetrate more than one-half of the cross-section of the material on the conveyor in approximately the same plane as the wheel and its spokes. A configuration in which the centers of the two wheels 11 are disposed above the conveyor 15 on opposite sides of its centerline 14 is illustrated in FIG. 2. On the other hand, if the size of the components to be separated is only slightly larger than the spacing between the spokes 12, it is preferable to position the centers of the wheels 11 so that the tips of the spokes penetrate the aggregate sufficiently to sieve the components on the basis of size.

A further improvement in the efficiency of removal of such objects may be achieved by positioning the downstream wheel 11 so that the angle of incidence of an object being moved by the conveyor in its longitudinal direction upon a face of one of its spokes 12 is greater than the corresponding angle of incidence for the upstream wheel. Then the spacing between the spokes 12 projected on a plane perpendicular to the conveyor 15 is less for the downstream wheel than for the upstream one; accordingly, smaller oversize objects can be dislodged by the downstream wheel 11. By way of example, in a wheel 11 in which the spacing between the centers of the outer extremities of a contiguous pair of spokes 12 is 6.5 inches, this projected distance is decreased approximately one-half inch as the angle A' is decreased from 40 to 35 degrees.

In other embodiments, the spacing between the spokes of the downstream wheel 11 can be reduced by increasing the number of spokes. Alternately, in certain applications, the conveyor speed may be increased to present a finer apparent spacing between the spokes 12 to an approaching oversize object.

To accomodate wide conveyors, rakes having three or more rotatable wheels 11 are provided. Similarly to a rake having two wheels 11, the wheels 11 in such a rake are disposed in successive transferring relationship with the one located furthest downstream being situated proximate the edge of the conveyor over which objects are forced as they are dislodged from the conveyor. An object initially contacting one or more spokes 12 of the upstream wheel 11 is diverted from its course parallel to the longitudinal axis of the conveyor and directed along a path which angles away from this axis until the object is forced off the edge of the conveyor. To facilitate the removal of large rocks, boulders and the like to a site beyond the supporting structure of the conveyor, the wheel located furthest downstream is preferably situated so that the circular path traversed by the extremities of its spokes extends beyond the edge of the conveyor by a distance of approximately one-half its radius. Alternately, the truss and any idler proximate to the edge of the conveyor over which the objects are dislodged may be covered by protective shields (not shown).

A rake having three wheels 11 may also be employed to separate large rocks and mudballs of comparable size from each other. In such an application, the two upstream wheels are positioned so that they create a furrow of these oversize objects to one side of the conveyor. By situating the third wheel a sufficient distance downstream, the heavier rocks tend to gravitate towards the centerline of the conveyor before ever reaching the wheel leaving behind the mud to be deflected off the conveyor. The efficiency of separation of the mud from the rocks may be further enhanced by positioning the wheel furthest downstream so that the angle of incidence of an object striking the face of one or more of the spokes is greater than the corresponding angle for the two upstream wheels.

Although the invention has been described with a certain degree of particularity, it should be understood that the present disclosure has been made by way of example. Consequently, numerous changes in details of construction and the combination and arrangement of the components as well as the possible modes of utilization, will be apparent to those familiar with the art, and may be resorted to without departing from the spirit and scope of the invention as claimed.

What is claimed is:

1. Apparatus for dislodging oversize objects from a moving conveyor which comprises:

(a) at least one wheel;

(b) a plurality of spokes which are rigidly attached to the wheel at spaced intervals, a portion of each spoke extending generally radially from the periphery of the wheel; and (c) means for positioning the wheel with the outer extremity of each spoke movable in a circular path which is spaced at a distance from the conveyor with the axis of symmetry of the wheel at an acute angle to the centerline of the conveyor, so that a portion of the momentum of an object moved thereon which strikes one of the spokes is converted into rotational motion of the wheel about the axis; each spoke being adapted upon rotation of the wheel to strike and impart impetus to an oversize object contiguous thereto to move it generally laterally across the conveyor.

2. Apparatus for dislodging oversize objects from a moving conveyor which comprises:

(a) at least one wheel;

(b) a plurality of spokes which are rigidly attached to the wheel at spaced intervals, a portion of each spoke extending generally radially from the periphery of the wheel; and (c) means for positioning the wheel with the axis of symmetry thereof at an acute angle to the centerline of the conveyor, each spoke being adapted to convert a portion of the momentum of an object moved on the conveyor which strikes said spoke into the energy required to rotate the wheel about the axis, each spoke being adapted upon rotation of the wheel to strike and impart impetus to an oversize object contiguous thereto to move it generally laterally across the conveyor.

3. Apparatus according to claim 2 wherein the positioning means further comprises:

(a) a shaft;

(b) means rotatably connecting the wheel to the shaft; and (c) means for anchoring the shaft in a fixed position relative to the moving conveyor, so that the wheel can absorb a portion of the translational energy of oversized objects which impact upon its spokes.

4. Apparatus according to claim 3 wherein the anchoring means further comprises:

(a) a support arm for slidably receiving the shaft, the arm having locking means for securing the shaft thereto;

(b) a mast rigidly attached to the support arm; and (c) a slider assembly having a tube for receiving the mast and locking means for securing the mast to the tube, thereby allowing adjustments in the position of the center of the wheel in both the horizontal and vertical directions.

5. Apparatus for dislodging oversize objects from a moving conveyor which comprises:

(a) at least one wheel mounted for rotation about an axis of symmety thereof, with the axis of symmetry at an acute angle to the longitudinal centerline of the conveyor; and (b) means connected to the wheel for applying a force in a direction generally laterally to the centerline of the conveyor to oversize objects which are contiguous said means, so that they tend to be deflected sideways, the wheel being driven by a portion of the translational energy imparted to the oversize objects by the conveyor.

6. Apparatus according to claim 5 wherein the means for applying torque enhances the rotational inertia of the wheel about its axis of symmetry, so that the means for applying torque can impart sufficient impetus to large boulders to flip them.

7. Apparatus according to claim 5 wherein the means for applying torque further comprises a plurality of spokes attached to the wheel, a portion of each spoke radiating therefrom at spaced intervals.

8. Apparatus according to claim 7 which further comprises means for positioning the wheel thereof on each of the spokes attached thereto movable in a circular path which is spaced at a distance from the conveyor which is greater than a height at which an object which has all of its cross dimensions less than a predetermined size tends to ride on the conveyor, the predetermined size being equivalent to a projection in a plane perpendicular to said centerline of the conveyor of the distance between two of said equidistant points on proximate portions of a contiguous pair of spokes, so that each object having said cross dimensions can pass between the spokes.

9. Apparatus for dislodging oversize objects from a moving conveyor which comprises:

(a) at least two wheels;

(b) a plurality of spokes which are rigidly attached to each wheel at spaced intervals, a portion of each spoke extending generally radially from the periphery of each wheel;

(c) means for positioning each wheel with the axis of symmetry thereof at an acute angle to the centerline of the conveyor, each spoke being adapted to convert a portion of the momentum of an object being moved on the conveyor as it impacts upon the spoke into energy required to rotate the wheel about the axis and upon rotation of the wheel to strike and impart impetus to move the object generally laterally across the conveyor; and (d) the wheels being positioned with the center of each wheel being spaced generally longitudinally from a wheel which is proximate thereto and in a direction generally laterally therefrom, the wheel which is positioned furthest downstream being disposed proximate the edge of the conveyor which oversize objects transverse as they are being dislodged.

10. Apparatus according to claim 9 which further comprises means for positioning each wheel with the outer extremity of each spoke movable in a circular path which is spaced at a distance from the conveyor, said distance for the circular path along which the outer extremity of each spoke of the upstream wheel moves being greater than said distance for the circular path along which the outer extremity of each spoke of the downstream wheel moves, so that the upstream wheel tends to dislodge larger oversize objects than does the downstream wheel.

11. Apparatus according to claim 10 wherein the positioning means is further characterized as having the centers of each proximate pair of wheels disposed so that the spokes of the upstream wheel of said pair are adapted upon the rotation of the wheel to deflect an oversize object contiguous at least one of said spokes a sufficient distance laterally that the object will encounter at least one of the spokes of the downstream wheel.

12. Apparatus according to claim 11 wherein the circular path along which the outer extremities of the spokes of the downstream wheel are movable, extends beyond the lateral edge of the conveyor, so that oversize objects which come in contact with at least one of its spokes tend to be forced laterally off the conveyor.

13. Apparatus according to claim 9 which further comprises means for positioning each downstream wheel with the axis of symmetry thereof at an acute angle to the centerline of the conveyor which is independent of the acute angle to the centerline of the conveyor at which the furthest upstream wheel is positioned.

* * * * *